US006627912B2

(12) United States Patent
Bandura et al.

(10) Patent No.: US 6,627,912 B2
(45) Date of Patent: Sep. 30, 2003

(54) METHOD OF OPERATING A MASS SPECTROMETER TO SUPPRESS UNWANTED IONS

(75) Inventors: Dmitry R. Bandura, Aurora (CA); Vladimir I. Baranov, Richmond Hill (CA); Scott D. Tanner, Aurora (CA)

(73) Assignee: MDS Inc., Concord (CA)

( * ) Notice: Subject to any disclaimer, the term of this patent is extended or adjusted under 35 U.S.C. 154(b) by 69 days.

(21) Appl. No.: 09/853,715

(22) Filed: May 14, 2001

(65) Prior Publication Data

US 2002/0166959 A1 Nov. 14, 2002

(51) Int. Cl.[7] ..... H01J 49/42

(52) U.S. Cl. ..... 250/582; 250/292

(58) Field of Search ..... 250/282

(56) References Cited

U.S. PATENT DOCUMENTS

| | | | | | |
|---|---|---|---|---|---|
| 4,731,533 | A | | 3/1988 | Vestal | |
| 4,963,736 | A | | 10/1990 | Douglas et al. | 250/292 |
| 5,661,300 | A | * | 8/1997 | Hansen et al. | 250/287 |
| 5,847,386 | A | | 12/1998 | Thomson et al. | 250/288 |
| 6,121,607 | A | * | 9/2000 | Whitehouse et al. | 250/288 |
| 6,140,638 | A | | 10/2000 | Tanner et al. | 250/282 |
| 6,163,032 | A | * | 12/2000 | Rockwood | 250/396 R |
| 6,222,185 | B1 | * | 4/2001 | Speakman et al. | 250/288 |

OTHER PUBLICATIONS

Rowan et al. "Attenuation of Polyatomic Ion Interferences in Inductively Coupled Mass Spectrometry by Gas–Phase Collisions", Applied Spectroscopy, vol. 43, No. 6, pp. 976–980, 1989.*

Hattendorf et al. "Optimization Criteria for the Operation of a Reaction Cell ICP–MS for Fast Transient Signal Acquisition", European Winter Conference on Plasma Spectrochemistry, Hafnell, Norway, paper # 0–75, Feb. 4–8, 2001.*

Thompson et al. "RF–Only Quadrupoles with Axial Fields", 44th ASMS Conference, Portland, Oregon abstract No. 1155, May 12–16, 1996.*

Loboda et al. "Novel LINAC II electrode geometry to create an axial field in a multipole ion guide", 48th ASMS Conference, Long Beach, California, paper # WPA 016, Jun. 11–15,2000.*

J.T. Rowan and R.S. Houk, "Attenuation of Polyatomic Ion Interferences in Inductively Coupled Plasma Mass Spectrometry by Gas–Phase Collisions", Applied Spectroscopy, vol. 43, No. 6, pp. 976–980, 1989.

A. Loboda, A. Krutchinsky, O. Loboda, J. McNabb, V. Spicer, W. Ens, and K. Standing, "Novel LINAC II electrode geometry to create an axial field in a multiple ion guide", 48$^{th}$ ASMS Conference, Long Beach, California, (paper # WPA 016), Jun. 11–15, 2000.

(List continued on next page.)

*Primary Examiner*—John R. Lee
*Assistant Examiner*—James J Leybourne
(74) *Attorney, Agent, or Firm*—Bereskin & Parr

(57) ABSTRACT

In a mass spectrometry system, a method of operating a processing section, for example a collision cell, is provided. The method is based on the realization that some interfering ions after collision will have significantly lower kinetic energy than desired analyte ions. These interfering ions can be ions originating from the source, or product ions formed by reaction with gas particles, or ions produced by other processes within the cell. Significantly, these interfering ions can have lower kinetic energies, as compared to desired analyte ions, but this energy differential disappears, or is much reduced, at the exit of the collision cell, rendering post-cell energy discrimination less effective. The invention provides a field within the cell to discriminate against the interfering ions based on their lower kinetic energy.

25 Claims, 5 Drawing Sheets

OTHER PUBLICATIONS

B. Thomson, C. Jollife and R. Javahery, 44$^{th}$ ASMS Conference, Portland, Oregon, (abstract No. 1155), May 12–16, 1996.

J.C.Y. Leblanc, G. Scott, J. Plomley and W. Scott, 46$^{th}$ ASMS Conference, Orlando, Florida, (abstract No. 1254), May 31 and Jun. 4, 1998.

B. Hattendorf and D. Gunther, "Optimization Criteria for the Operation of a Reaction Cell ICP–MS for Fast Transient Signal Acquisition", European Winter Conference on Plasma Specttochemistry, Hafnell, Norway, (paper No. 0–75), Feb. 4–8, 2001.

* cited by examiner

METHOD OF OPERATING A MASS SPECTROMETER TO SUPPRESS UNWANTED IONS

FIELD OF THE INVENTION

This invention relates to a method of operating a mass spectrometer to suppress unwanted ions.

BACKGROUND OF THE INVENTION

Collision cells are widely used for Collision Induced Dissociation (CID) of precursor ions in Mass Spectrometry. Usually, the product ions of the desired CID are intended to be conducted efficiently to the next stage of a tandem mass spectrometer in order to be mass-analyzed and detected. However, many unintended or undesired processes can occur in the collision cell, producing undesirable ions, for example, cluster ions, or un-specific fragment ions that elevate chemical background and decrease signal-to-noise ratio for the ions of interest measured by a downstream mass analyzer.

Reaction/collision cells are commonly used in Inductively Coupled Plasma Mass Spectrometry for suppression of unwanted ions originating from the ion source, which often is an Argon inductively coupled plasma source (Ar ICP). For example, $Ar^+$, $ArO^+$, $Ar_2^+$, $ClO^+$ etc. are generated in Ar ICP. In such cells, together with "useful" reactions that suppress interfering ions, other reactions can take place, for example, cluster formation, atom-transfer reactions, and condensation reactions that produce "undesirable" product ions that elevate background at the mass of interest measured by downstream analyzer. Generally these reactions can reduce signal-to-background ratio.

There are also collision cells in Mass Spectrometry that are used only as transmission devices, that utilize collisional focusing, to achieve spatial focusing or temporal beam homogenization. In such cells any reactions are often un-desirable, and product ions of such reactions decrease the performance of the mass spectrometer due either to elevation of the background at the mass of interest, or to loss of the analyte signal due to the reaction. U.S. Pat. No. 4,963,736 discloses such a technique sometimes identified as collisional focusing.

To date, there are three known ways to control the products of undesirable reactions in such pressurized reaction/collision cells.

One way is to accelerate ions while they are transported through the pressurized device in order to reduce the residence time and/or increase the ion velocity between the collisions so that undesirable reactions' cross-sections are reduced. This is achieved by application of the axial internal field and is described in the patent U.S. Pat. No. 5,847,386 by Bruce A. Thomson and Charles L. Jolliffe, and assigned to MDS Inc. (the assignee of the present invention). This ion acceleration method does suppress cluster ion formation, but other reactions (for example, atom-transfer) are not intercepted, and, in fact, some endothermic reactions can be promoted by supplying through the axial internal field some additional energy to the collision complex.

A second way is to prevent formation of undesirable product ions by making the parent or intermediate product ions unstable in the rf-quadrupolar field of the pressurized cell, as described in the patent U.S. Pat. No. 6,140,638 by Scott D. Tanner and Vladimir I. Baranov (also assigned to the assignee of the present invention). By changing the parameters of the quadrupole (a and q), the range of ion masses that are unstable in the cell can be changed. As unstable ions are ejected from the cell, they do not contribute to the undesirable product ion formation. The approach has proven itself very successful in intercepting unwanted sequential chemistry in the Inductively Coupled Plasma Dynamic Reaction Cell Mass Spectrometry (ICP DRC™ MS), (DRC is a trade mark of the assignee of the present invention). The highest efficiency achieved to date in ICP DRC MS has given 9 orders of magnitude of suppression of unwanted Ar+ without significant suppression of analyte ions, by charge-exchange with $NH_3$, and this is done without significant elevation of chemical background. The approach works well when the analyte and the unwanted precursor ion have a relatively large difference in mass, so that the unwanted precursor ion can be efficiently removed without significant suppression of the desired analyte. A typical example of the method is detection of $^{52}Cr^+$ which can suffer interference by $(NH_3)_3H^+$ for a cell pressurized with $NH_3$, where the primary precursor ion of the interfering cluster ion is $NH_4^+$ (m/z=18). When the signal at m/z=52 is measured at q (m/z=52)=0.4, the precursor ion ($NH_4^+$) that forms the interfering cluster ion, is unstable in the quadrupole field, as its stability parameter q, which is inversely proportional to the ion mass, is $$q_{m1} = q_{m2} \times \frac{m2}{m1} = 0.4 \times \frac{52}{18} = 1.2$$

which is outside of the stability boundary.

However, if the relative difference between the undesired product ion mass and the unwanted precursor ion mass is low, as, for example, between product $CeO^+$ at m/z=156 and the precursor $^{140}Ce^+$, then measurement of a desired analyte $^{156}Gd^+$, likely to suffer interference from $CeO^+$, may require q=0.82 in order for $^{140}C\ e^+$ to be unstable in the quadrupole. Such a high q will cause significant suppression of the $^{156}Gd^+$ signal.

A third way of discriminating against unwanted product ions is by applying kinetic discrimination downstream of the pressurized cell, as described by J. T. Rowan and R. S. Houk in their paper "Attenuation of Polyatomic Ion Interferences in Inductively Coupled Plasma Mass Spectrometry by Gas-Phase Collisions", Applied Spectroscopy, 1989, 43,976. This approach works best for the cells pressurized to a relatively low pressure. Ions that are produced in the cell, including undesirable product ions, have somewhat lower kinetic energy after leaving the cell, than the ions desired for detection (analyte ions) that retain some of the kinetic energy with which they entered the cell, provided there are not enough collisions to smear the difference in energy by collisional energy damping. This approach cannot be successfully used if, for high efficiency of the desired reaction, a high number of collisions and thus high gas pressure are required.

SUMMARY OF THE INVENTION

The present invention provides a fourth, novel and inventive way to discriminate against product ions produced in a pressurized device, by applying an energy discrimination principle continuously during the ion transport through the cell. The invention provides a retarding field inside the cell, so that the product ions are discriminated against after each collision, i.e. immediately after they are formed and before their energy is damped by further collisions. There are at least two "types" of unwanted ions that the invention may help to alleviate. First, ions that are produced within the cell and may interfere with the determination of an analyte ion. Second, polyatomic ions that may be produced in the cell or may be sampled from the ion source and that may interfere with the determination of an analyte ion. In either instance, the impact of the retarding internal field has a similar effect, but we will discuss them separately as the polyatomic ion alleviation has some special characteristics. Relative to the initial energy of the ions as they enter the cell, the neutral gas molecules within the cell may normally be considered stagnant. Ions, both wanted and unwanted, lose kinetic energy in collision with the neutral gas molecules. Ions that are transformed by the exchange of a particle (electron, atom or ligand), and hence may form a new isobaric interference for an analyte ion, will tend to have less kinetic energy than an atomic ion which collides without chemical transformation. This is because at least a part of the transformed ion is derived from the stagnant neutral molecule.

In the special instance of polyatomic ions, either produced by reaction within the cell or sampled from the source, some of the energy that is delivered to a collision complex from the ion's pre-collision kinetic energy can be distributed into the internal degrees of freedom of the product (or original ion that has undergone collision without reaction) polyatomic ion. As a result, its post-collision kinetic energy can be lower than the kinetic energy of an atomic ion of the same mass to charge ratio. Moreover, the polyatomic ions due to their relatively large size may have significantly larger collision cross-sections than that of atomic ions. As a result, they would experience a larger number of collisions and thus would on average lose more kinetic energy per unit length than atomic ions would. The present invention provides a relatively low kinetic energy barrier applied as a continuous field that decelerates the ions and that appears as a kinetic energy barrier to ions whose energies after collision are sufficiently low. Since the undesired product ions and some polyatomic ions, have lower energies after collision than do desired analyte ions, there is a higher probability of the undesired ions being discriminated against, while un-reacted analyte ions can still penetrate through the energy barrier. According to the present invention in which the collisions happen in a retarding internal field, ions that have less energy following collision necessarily have lower transmission to the downstream analyzer when compared to the analyte ions.

Thus, in accordance with the present invention, there is provided a method of operating a mass spectrometer system including a processing section having an input and an output, the method comprising:

a) providing a stream of ions to the input of the processing section defining a path for travel of ions and including means for guiding ions along the path;

b) passing the stream of ions through the processing section which is operated under conditions enabling collisions of ions with neutral particles;

c) providing an internal field extending along at least part of the path of the processing section, to retard movement of ions through the processing section; and d) selecting the internal field to provide significantly greater retardation to unwanted ions having lower kinetic energy than desired analyte ions, thereby to promote retardation of said unwanted ions and preferential loss of said unwanted ions and to enhance the ratio of said analyte ions to said unwanted ions.

Preferably, the invention includes detecting ions exiting from the processing section. However, it is possible that the ions could be subject to some additional processing, e.g. steps of fragmentation, reaction and/or mass selection, prior to final detection.

The unwanted ions could come from a variety of sources. Generally, the unwanted interfering ions can be ions originating from the ion source, product ions formed by reaction with gas particles in the cell, or ions produced by other processes within the cell. It is also expected that in most cases, the kinetic energy differential between unwanted, interfering ions and desired, analyte ions will result from collision processes in the cell. However, it is possible that unwanted ions could enter the cell with a lower kinetic energy than the desired ions, or at least part of the energy differential will be present when ions enter the cell.

BRIEF DESCRIPTION OF THE DRAWINGS

For a better understanding of the present invention and to show more clearly how it may be carried into effect, reference may now be made, by way of example, to accompany the drawings which show preferred embodiments of the present invention and in which.

DESCRIPTION OF THE PREFERRED EMBODIMENTS OF THE INVENTION

Figure 1:
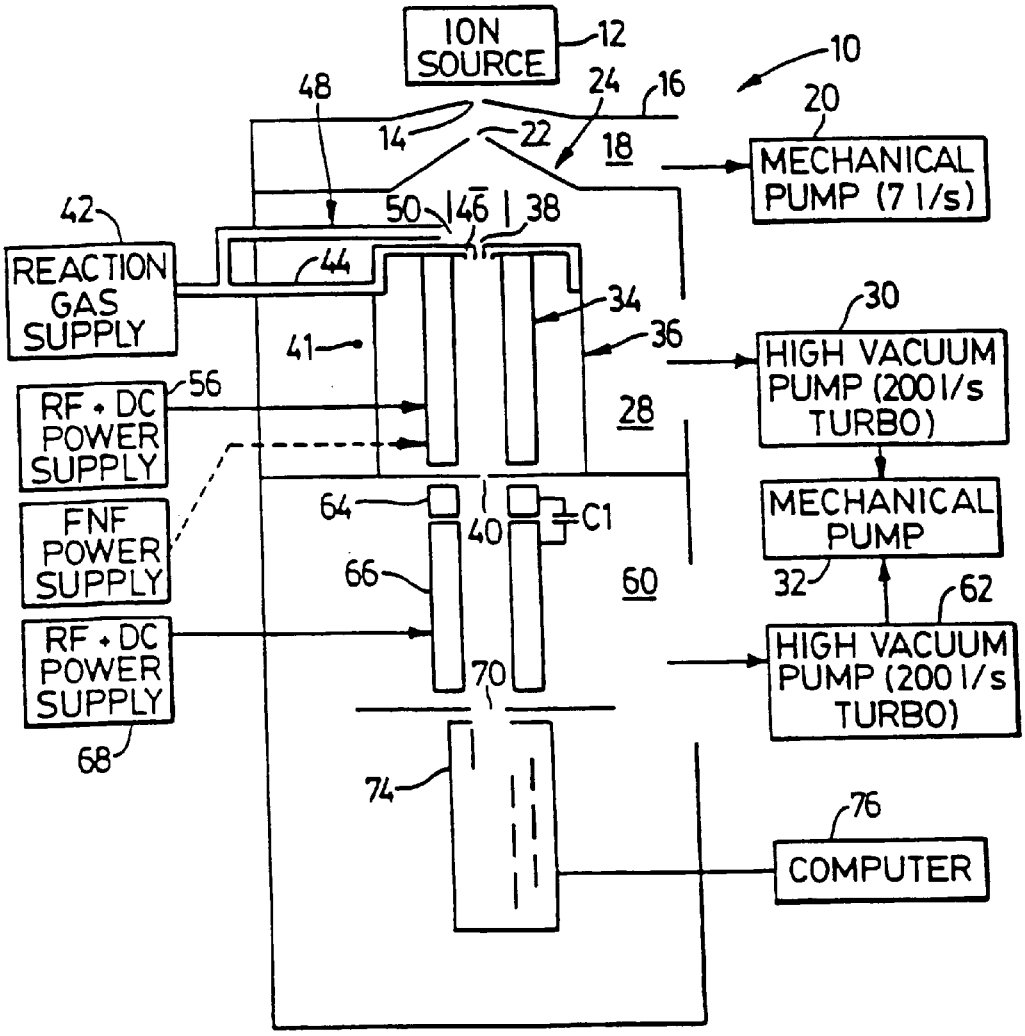
FIGURE 1 PRIOR ART
FIG. 1 is a schematic of a mass spectrometer system, suitable for carrying out the present invention.

FIG. 1 illustrates a mass spectrometer system 10 as disclosed in U.S. Pat. No. 6,140,638, assigned to the same assignee as the present invention, and the contents of which are hereby incorporated by reference, and suitable for carrying out the method of the present invention as described below, when modified to provide an internal field, e.g. by including auxiliary electrodes as in FIG. 2.

The system 10 comprises an inductively coupled plasma source 12, a collision/reaction cell 41, a pre-filter 64 and a mass analyzer 66. It is to be understood that the cell 41 can be configured and used for one or both of collision and reaction between a gas introduced into the cell 41 and ions entering the cell 41. The inductively coupled plasma source 12 ionizes a sample material for analysis, and then injects it in the form of a stream of ions through a first orifice 14 in a sampler plate 16. As the stream of ions pass through the first orifice 14, they enter into a first vacuum chamber 18 evacuated by a mechanical pump 20 to a pressure, of for example, 3 torr. The stream of ions passes on through the first chamber 18, and through a second orifice 22 in a skimmer plate 24. As the stream of ions pass through the second orifice 22, they enter a second vacuum chamber 28, which is evacuated to a lower pressure (e.g. 1 millitorr) by means of a first high vacuum pump 30. Within the second vacuum chamber 28, the ion stream enters a quadrupole 34 through entrance aperture 38. The quadrupole 34 is loaded in a can or housing 36 to form the collision cell 41. The quadrupole 34 provides a means for guiding ions and defines a path for the travel of ions.

Reactive collision gas is supplied from a gas supply 42 and can be supplied in any known manner to the interior of can 36. As shown, the collision gas can be arranged to flow through a conduit 44 and out through an annular opening 46 surrounding orifice 38. As the collision cell 41 is at a higher pressure than the chamber 28, gas exits into chamber 28 through aperture 38, against the ion current flow. This gas flow prevents or reduces unionized gas from the source 12 from entering the can 36. A secondary conduit 48 from gas supply 42 terminates at a position 50 just in front of the orifice 38, so that reactive collision gas is directed into the ion stream before it enters quadrupole 34. The position 50 can in fact be any position upstream of the orifice 38, and downstream of the ion source 12.

The mass spectrometer system 10 is primarily intended for analyzing inorganic analytes. For this purpose, the inductively coupled plasma source 12 commonly utilizes argon gas that is subject to a field that, through induction, excites and ionizes the argon gas. An analyte sample is injected into the resultant ionized plasma, causing ionization of the analyte. The plasma, comprising argon and analyte ions, passes through the orifice 14, as indicated. Such a plasma has a large concentration of ions, many of which are unwanted ions of argon or argon compounds. Consequently, it is highly desirable to eliminate or reduce interferences caused by unwanted ions, and the collision/reaction cell 41 is used for this purpose. U.S. Pat. No. 6,140,638 is directed to a bandpass technique that, essentially, interferes with chemical reaction sequences that can generate new interferences inside the cell 41. The technique involves setting a and q values so as to establish a desired bandpass, within which desired analyte ions are stable. It is also selected so that major interfering ions, or intermediates or precursors of these ions, are unstable. Then, the sequential chemistry generating these interfering ions is interrupted, so that the interfering ions are not detected.

The present invention modifies the basic structure of the collision cell 41, to add a device for generating an internal field for retarding ions. Further, the present invention may be used instead of or with the original DRC. It has the advantage that it can be used with a higher order multipole operating with or without a "bandpass".

Figure 2A:
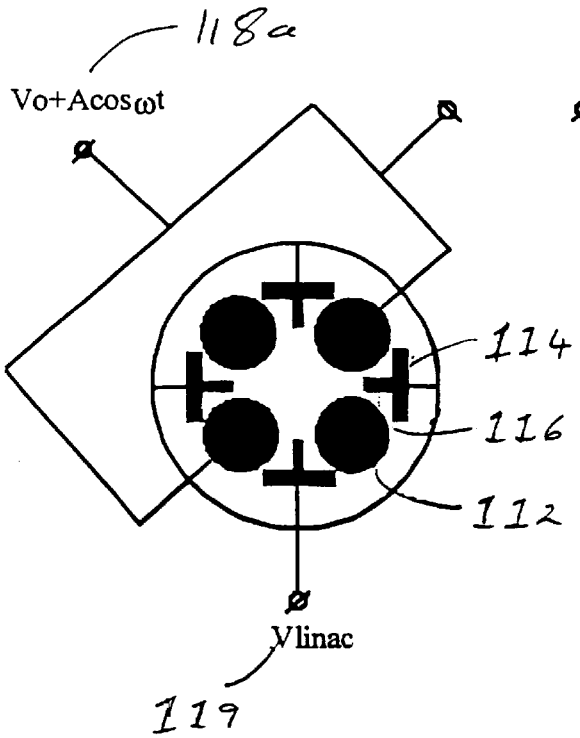
FIGS. 2*a* and 2*b* show schematic cross-sectional views through a preferred embodiment of a quadrupole rod set with auxiliary electrodes for use in the mass spectrometer system of FIG. 1.
Figure 2B:
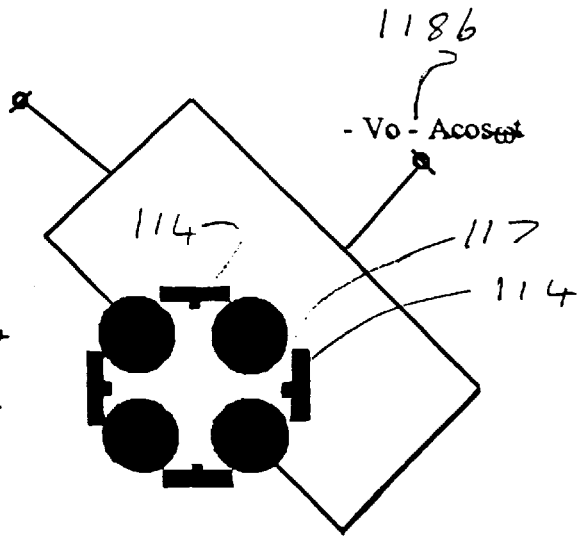

Reference will now be made to FIGS. 2*a* and 2*b* that show a preferred arrangement for generating an internal field. In addition to the rods 112 that establish the RF/DC-field of the multipole (shown as round cross-sections in FIG. 2 and comparable to the rod set 34 of FIG. 1), there is provided a plurality of elongated auxiliary electrodes 114, each having a generally T-shaped cross-section. Thus, each auxiliary electrode 114 has a blade section that extends radially inwardly toward the axis of the multipole between the multipole rods 112. The radial depth of this blade section varies along the axis, so that the cross-sections of the auxiliary electrodes 114 vary along the axis. As shown, this profile for the blade section is such that the DC voltage or plurality of voltages applied to the elongated rods 114 establishes a potential on or adjacent the axis that varies along the multipole, thus providing an internal field. For example, the cross section provided in FIG. 2*a* shows a blade section 116 protruding radially deeper between the rods 112, while the cross-section in FIG. 2*b* shows a shorter blade section 117 protruding less in the radial direction between the rods 112. By placing the deeper protruding ends 116 of elongated electrodes 114 closer to the entrance of collision/reaction cell 41, and less protruding ends 117 closer to the exit of the collision/reaction cell 41, and by supplying to the auxiliary elongated electrodes 114 a negative potential relative to a DC offset potential of the rods 112, one can establish an electrostatic field along the cell, that serves to retard motion of positive ions from the entrance to the exit. It is also possible to reverse the configuration of the auxiliary electrodes 114, i.e. to have the deeper protruding ends at the exit and the less protruding ends at the entrance and to use a positive DC voltage, to achieve the same effect. The distribution of the potential along the multipole is preferably linear, i.e. the internal field is substantially uniform, so as to provide equal force pushing the ions through the multipole to its exit. However it can be made to vary from linear by appropriate tailoring of the profile of the elongated electrodes 114 shape and/or depth of penetration between the multipole rods 112. It has been found that a curved profile is necessary for the blade sections 116, 117, to give an approximately linear potential distribution.

A conventional voltage supply is indicated at 118*a*, 118*b* and connected to the rods 112 in a quadrupolar fashion, for supplying RF and DC voltages. A DC voltage source 119 is connected to the auxiliary electrodes 114, as indicated.

However, it is to be understood that the invention is not limited to this arrangement, and further that details of the spectrometer system described can be varied in known manner. For example, while the collision cell 41 is described as having a quadrupole 34, it will be understood that any suitable electrode configuration can be used. More particularly, other multipoles, e.g. hexapoles and octapoles, could be used, and the present invention provides means of discrimination against unwanted ions in such multipoles that otherwise cannot efficiently suppress production of unwanted ions because they do not provide well defined stability boundaries.

Additionally, it will be understood by those skilled in the art that the invention could have application to other types of spectrometers. For example, a different class of spectrometers is configured for analyzing organic analytes. Commonly, organic analytes are ionized using an electrospray source or some other equivalent source. Further, the operating conditions in this class of spectrometers are usually quite different. An electrospray source does not tend to produce a high level of background, unlike an ICP source, so there is no necessity to provide a collision/reaction cell for the purposes of removing the background. On the other hand, it is often desirable to fragment the complex organic analyte ions, to analyze them, and collision/reaction cells are often used for such fragmentation to effect a variety of analytical techniques. The fragments or products are then the desired analyte ions. Nonetheless, this class of spectrometers do include collision cells and there may be advantages of employing the technique of the present invention, providing a retarding field, in such a spectrometer. It is anticipated that the retarding field of the present invention could be used to discriminate against unwanted products produced in the cell, by retarding them. In certain circumstances, it is expected that a retarding field may have beneficial effects.

It will also be understood that the mass analyzer of the disclosed apparatus, detailed below, can be replaced by any suitable mass analyzer, for example, a sector mass analyzer, a time of flight mass analyzer, or an ion trap mass analyzer.

In accordance with U.S. Pat. No. 6,140,638, the quadrupole is operated to provide a desired bandpass. Thus the quadrupole can be operated as an RF-only device, i.e. as an ion transmission device, which is a low mass cutoff bandpass device, i.e. it allows transmission of ions above a set of m/z value. However, low level resolving DC may also be applied between the rods, to reject unwanted ions both below and above a desired pass band. These voltages are supplied from a power supply 56.

Ions from dynamic reaction cell or collision cell 41 pass through an orifice 40 and enter a third vacuum chamber 60 pumped by a second high vacuum turbo pump 62 with a mechanical pump 32 backing up both the high vacuum pumps 30, 62. The pump 62 maintains a pressure, of for example, $1_10^{-5}$ torr in the vacuum chamber 60. These ions travel through a pre-filter 64 (typically an RF-only short set of quadrupole rods) into a mass analyzer 66 (which is typically a quadrupole but, as noted, may also be a different type of mass analyzer such as a time-of-flight mass spectrometer, a sector instrument, an ion trap, etc., and appropriate minor changes to the arrangement shown would be needed for some other types of spectrometers). The quadrupole 66 has RF and DC signals applied to its rods from a power supply 68 in a conventional manner, to enable scanning of ions received from dynamic reaction cell 41. Typically, the prefilter 64 is capacitively coupled to the quadrupole 66 by capacitors C1, as is conventional, thus eliminating the need for a separate power supply for the pre-filter 64.

From the quadrupole 66, the ions travel through an orifice 70 in an interface plate 72 and into a detector 74, where the ion signal is detected and passed to a computer 76 for analysis and display.

In accordance with U.S. Pat. No. 6,140,638, the mass spectrometer system 10 provides a bandpass tunable collision cell or dynamic reaction cell 41, where varying or tuning the RF voltage amplitude, the DC voltage and/or the RF frequency (by means of power supply 56) to the quadrupole 34 controls the band (or m/z range) of ion masses transmitted through to the third vacuum chamber 60. The low mass end of the bandpass is defined primarily by the RF amplitude and frequency supplied to quadrupole 34, where the high mass end of the transmission window is primarily defined by the DC voltage amplitude applied between pole pairs of the quadrupole 34. Hence, only the m/z range of interest is selectively coupled to the mass analyzer. This eliminates intermediates or interference ions, before they have an opportunity to create isobaric or similar interferences. However, as discussed, there are interferences that cannot be eliminated with this technique. Also, for other reasons, the bandpass technique is not always applicable, e.g. in higher order multipoles, it is not possible to set well defined boundaries for a pass band. Thus, it is intended that the retarding field of the present invention can be used instead of or together with this bandpass technique, depending on the interfering ions present.

Due to high pressures present in a DRC, of the order of 10 to 50 mTorr, the DRC can only be set to reject precursor ions with a mass substantially different from the mass of the desired analyte ion. This does mean that this technique may be incapable of intercepting and rejecting unwanted precursor ions with an m/z close to the m/z of a desired analyte ion; the DRC technique can be used successfully to prevent generation of interfering ions at the mass of an analyte, where there is a precursor to the interfering ion with a substantially different mass. Accordingly, the present invention provides a technique for discriminating against these unwanted ions, based on a different principle, namely the realization that unwanted product ions and desired ions will often have different kinetic energies immediately after collision, and discrimination between them is best effected in the collision cell 41 immediately after the product ions are formed. Importantly, it has been realized that the energy discrimination should be applied inside the cell, before further collisions make the energy distributions of the unwanted and wanted ions very similar and thus energy discrimination inefficient.

In accordance with the present invention, it is proposed to provide an internal field within the collision cell 41. For this purpose, the collision cell 41 is modified in accordance with U.S. Pat. No. 5,847,386, the contents of which are also incorporated by reference. That patent discloses a number of methods for generating an axial or internal field. These include one or more of: tapered rods; inclined rods; segmented rods; auxiliary rods, which may extend only partially along the main rod set of the collision cell, which may be provided as different groups of auxiliary rods at different locations in the collision cell and which may be inclined. FIGS. 2*a* and 2*b* show a more recent development of the auxiliary electrode configuration, which relies on the principles disclosed in U.S. Pat. No. 5,847,386, and is intended to provide a more linear field. A further possibility for generating an internal field is to provide external electrodes, such as rings surrounding the multipole array, or a multipole housing having a voltage that varies across its length, such as could be obtained using a segmented housing, so that the internal field penetrates through the multipole rod set to the axis, where the ions are traveling.

Figure 3:
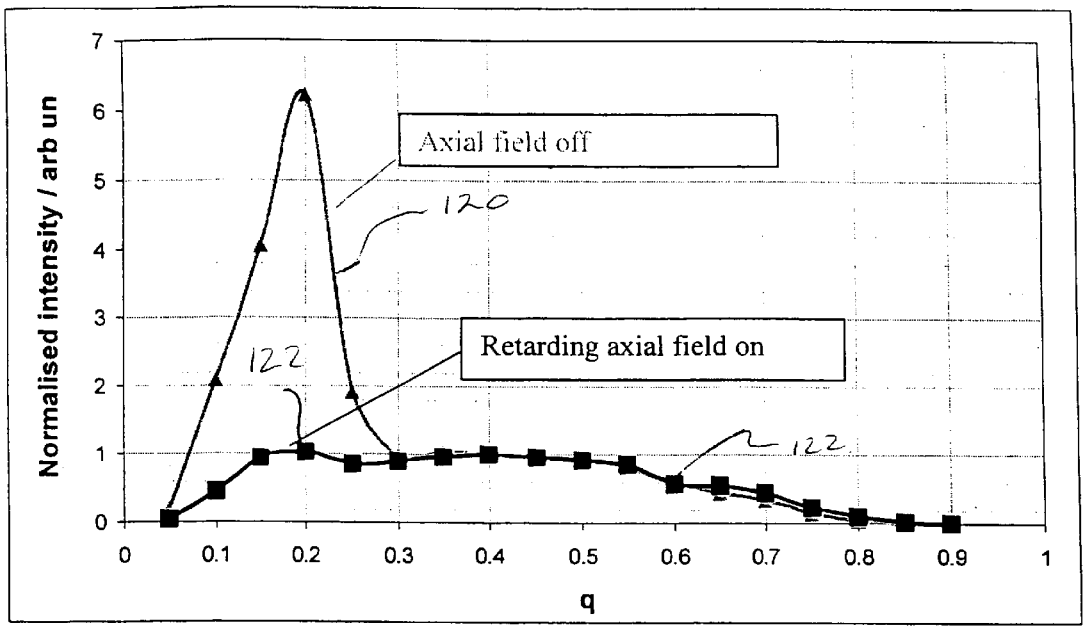
FIG. 3 is a graph showing variation of normalized intensity data with factor q in the collision cell of FIG. 1, with and without retarding internal field applied according to the present invention.

Referring now to FIG. 3 this shows characteristics of a collision cell pressurized with $NH_3$ when the signal at m/z=52 is measured for a sample containing Cr. It is known from experience operating the collision cell 41, or dynamic reaction cell, with $NH_3$ gas, that a relatively high abundance of $(NH_3)_3H^+$ can be formed in the cell and this has an m/z of 52, which interferes with the detection of $^{52}Cr^+$ at m/z52. Curve 120 shows a normalized intensity of ion signal at m/z=52, in arbitrary units, obtained when no internal field is present, as a function of the quadrupole parameter q set for m/z=52. As can be seen, there is a peak around q=0.2, and this tails off at higher q's. Now, $NH_4^+$, at m/z=18, is probably the parent ion for $(NH_3)_3H^+$. At low q, ions of m/z=18 are stable, and hence the peak in the curve 120. When a higher q is applied, the precursor ions, at m/z=18, are unstable and hence formation of the cluster ion is suppressed. This is the now established technique of the dynamic reaction cell, disclosed in U.S. Pat. No. 6,140,638.

However, in accordance with the present invention, it has now been realized that suppression at even low q can be achieved by application of a retarding internal field. The retarding internal field could be produced by a variety of techniques, including all of the techniques in U.S. Pat. No. 5,847,386, or by a segmented collar. The data of FIGS. 4 and 5 were obtained using a device which established an internal field using the T-shaped auxiliary electrodes identified above.

Thus, the results of the internal retarding field are indicated by curve 122, and as shown, at a low q around 0.1–0.2, when the precursor ion is stable, the energy discrimination against the cluster is realized through the continuous internal retarding field, providing an improved ratio of $^{52}Cr^+$ to $(NH_3)_3H^+$.

Figure 4:
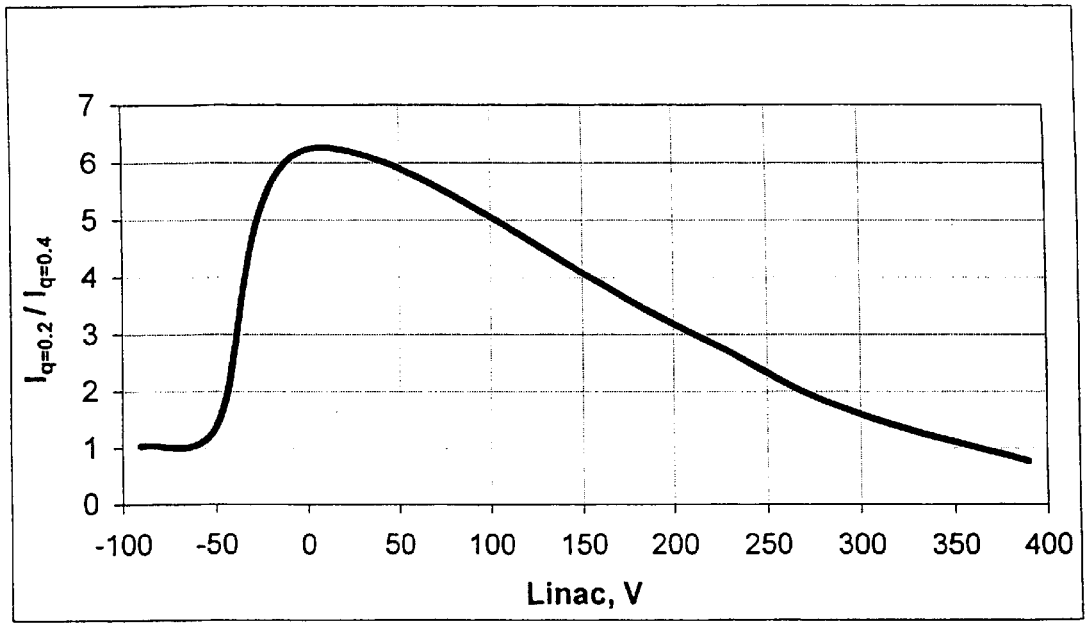
FIG. 4 is a graph showing ratio of a detected signal for different q values, as a function of retarding field strength in the collision cell of FIG. 1.

FIG. 4 shows the effect of an internal field, derived from a "LINAC" voltage applied to the auxiliary electrodes. FIG. 4 shows variation of the ratio of ion intensity at q=0.2 to ion intensity at q=0.4 with the applied voltage, and note that the actual field, derived from the applied voltage, is much less.

At a q value of 0.2, the signal is mainly $(NH_3)_3H^+$; as shown in FIG. 2, at q=0.4, formation of the cluster $(NH_3)_3H^+$ is suppressed, so that the signal is mainly $^{52}Cr^+$. This graph shows that with a retarding field, i.e. with the potential less than zero (the potential is less than zero for the particular electrode configuration used, and can be different in other arrangements or shape of electrodes, as noted above in relation to FIG. 2) one can obtain at least a six fold suppression of the transmission of the ion cluster (bearing in mind that the residual signal is probably dominated by the $Cr^+$ itself, the enhancement factor is significantly greater), and this is shown strongly at voltages less than minus 50 volts. As this curve shows, an accelerating field can also reduce the signal of cluster ions, most likely by suppressing their formation.

The retarding field, provided by applying the negative voltage, might be expected to promote cluster formation, since as ions are slowed the cluster formation cross-section increases. However, the retarding field applied, while it may promote formation of clusters, prevents these clusters penetrating through the energy barrier due to the lower kinetic energy of the clusters. Thus, whatever the level of generation of clusters, they are not detected.

Figure 5:
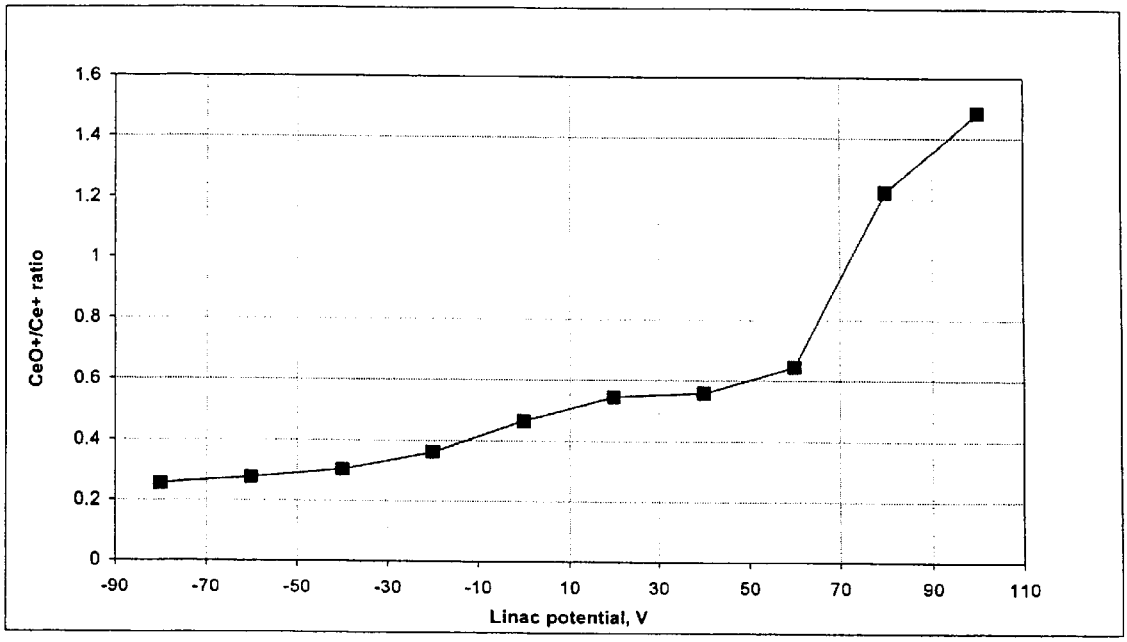
FIG. 5 illustrates the principle of retarding field suppression of $CeO^+$, produced in the pressurized collision cell of FIG. 1.
Figure 1:
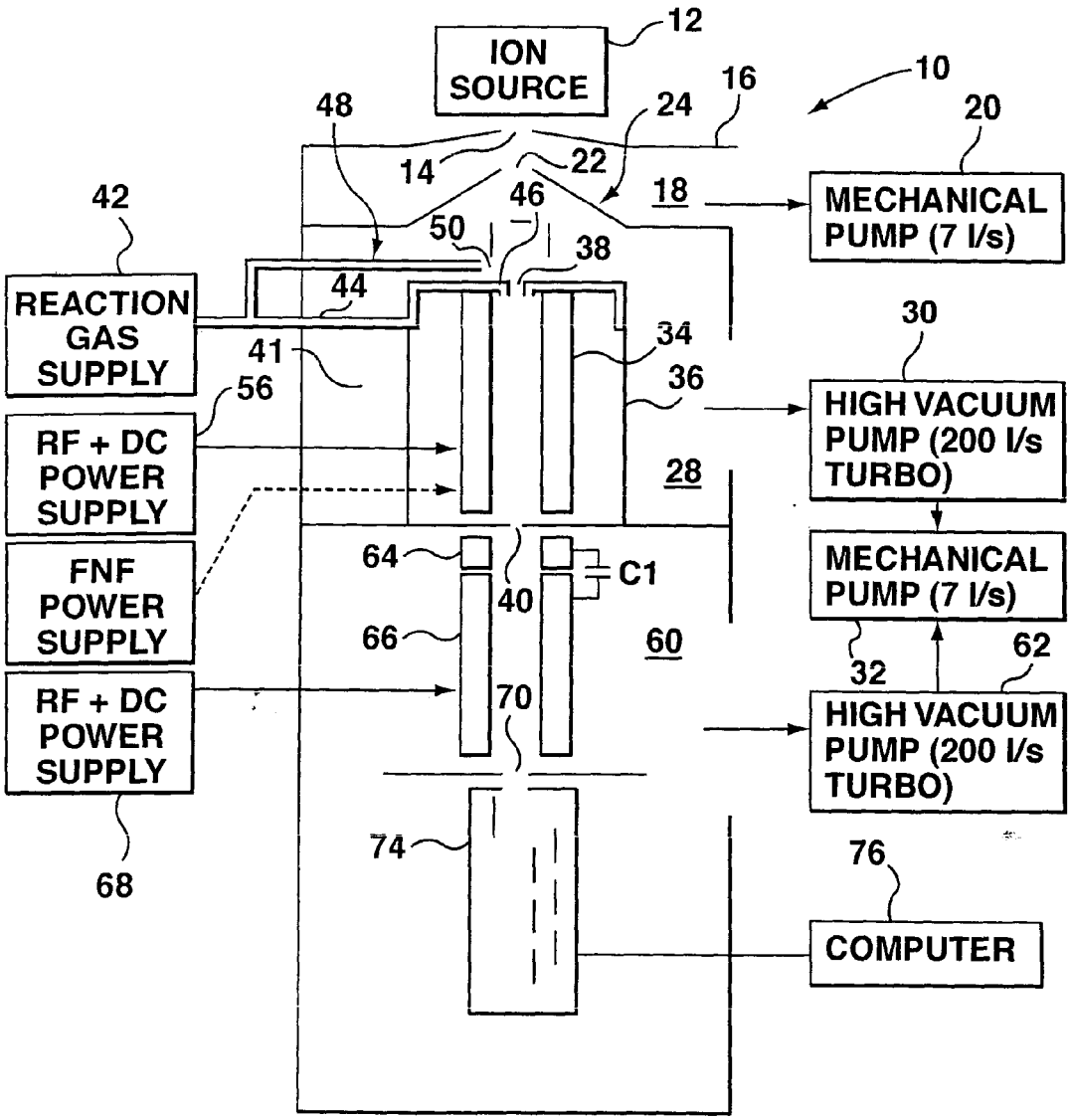
FIG. 1 (Prior Art)
Figure 4:
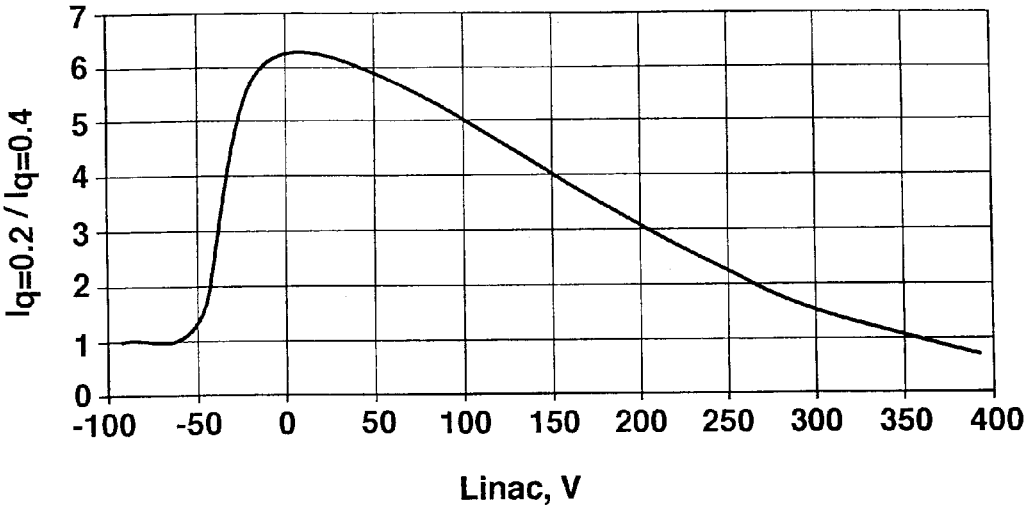
Figure 5:
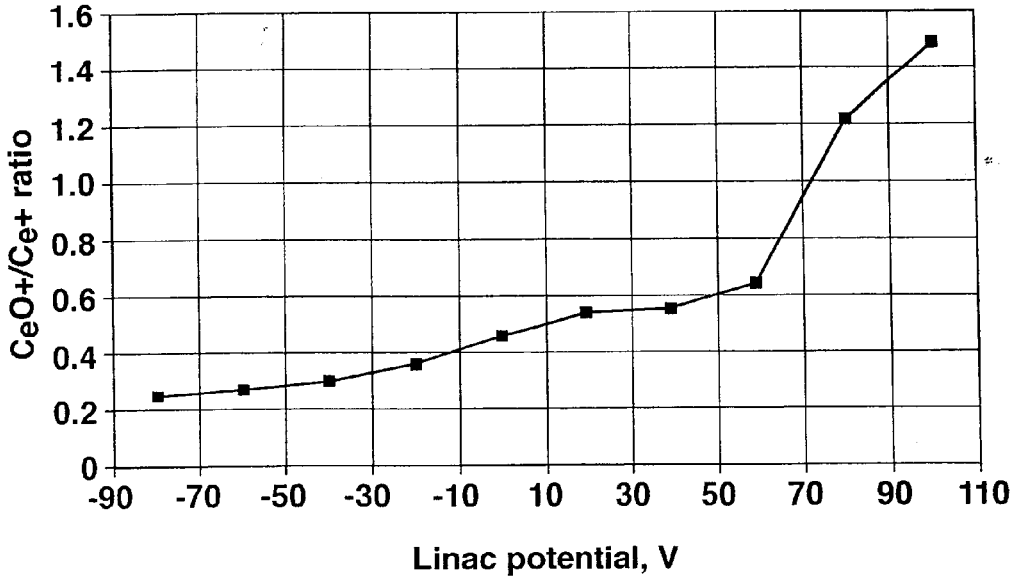
Figure 2A:
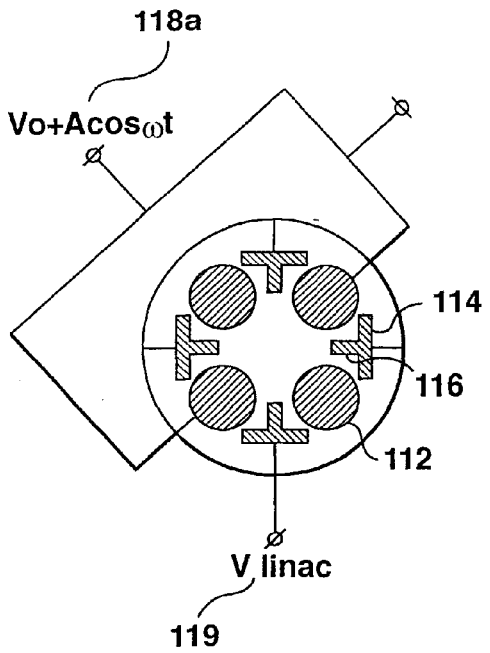
Figure 2B:
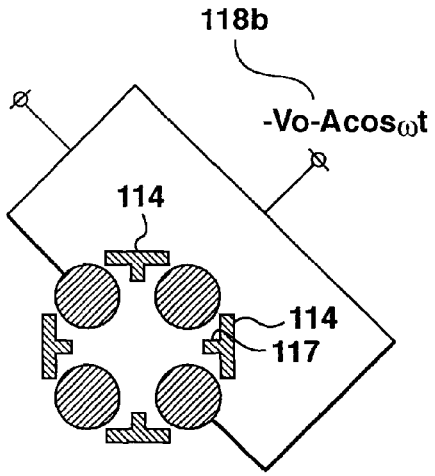
Figure 3:
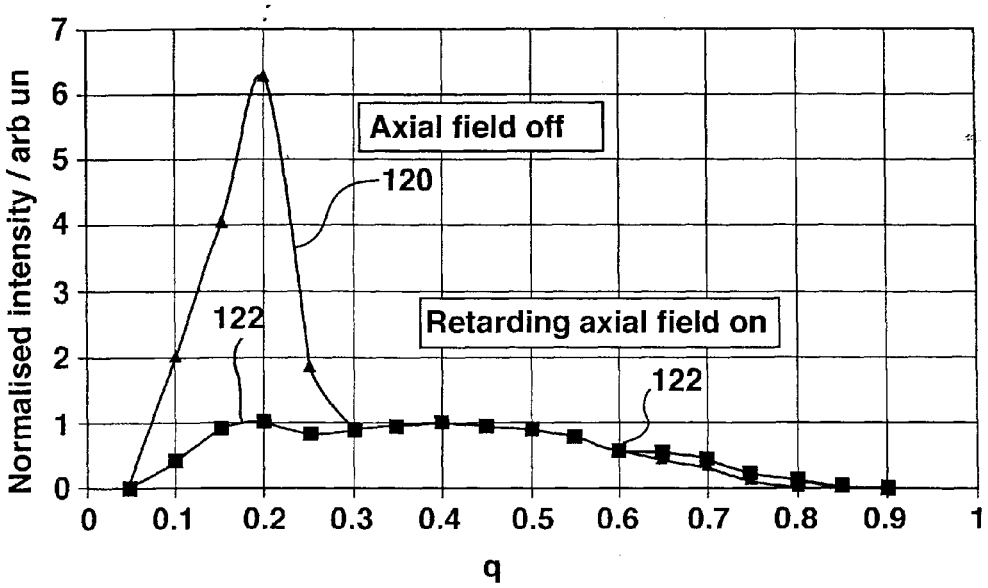

Referring to FIG. 5, this illustrates the principle of the present invention, a retarding internal field, applied to suppression of $CeO^+$ produced in a pressurized reaction cell, by reaction of $Ce^+$ with oxide impurities in the reaction gas. This shows the variation of the ratio $CeO^+/Ce^+$ as a function of the internal field potential. Once $CeO^+$ is produced within the cell, it tends to have a low kinetic energy. Hence, as the potential is increased, in the positive direction, the ratio of $CeO^+$ to $Ce^+$ increases, showing that the accelerating internal field in this case helps to transport product ions more efficiently. Thus, the ratio of $CeO^+/Ce^+$ at high accelerating positive internal field can be high. In contrast, when a retarding internal field is applied, i.e. with a negative voltage, the ratio $CeO^+/Ce^+$ drops about two times in comparison with no or zero field.

The present invention has a number of advantages. Firstly, it can be combined with the bandpass concept in the dynamic reaction cell, again detailed in U.S. Pat. No. 6,140,638, to provide more efficient suppression of in-cell produced ions. It is particularly applicable in this situation when the bandpass on its own is less efficient, due to the precursors of the relevant interferences having similar m/z ratios to ions of interest. Secondly, it can be applied without the bandpass concept, and in this instance can be competitive with the bandpass method in some instances.

Post-cell discrimination is not useful at high cell pressure where all ions are near-thermal; it is useful only at lower pressures that allow the source ions to retain a sufficient fraction of their initial energy that they can be discriminated from ions produced within the cell. But high pressure provides efficiency of removal of the source-based interference ions, and hence is desirable. Thus, at higher pressures, post cell energy discrimination is less efficient than the use of a bandpass in the collision cell itself (Bodo Hattendorf, Swiss Federal Institute of Technology, Zurich, winter Conference Feb. 4–8, 2001, Lillehammer, Norway). Since the internal field deceleration approach works also at high pressure, it is clearly superior to post-cell discrimination.

The present invention is readily applicable to a wide variety of collision cell configuration and designs, including multipoles of various orders. More particularly, it can be implemented by an auxiliary rod set, largely independently of the configurations of electrodes already present in the collision cell. The inventors believe that in-cell energy discrimination by a retarding internal field at high gas pressures is more efficient than post-cell energy discrimination. In post-cell energy filtering, the problem arises that the energy distribution of the in-cell produced polyatomic ions can overlap that of the desired, non-reacted atomic analyte ions, especially at higher cell pressures which offer higher efficiency of reactive removal of the original isobaric interference. As such, it can be impossible to set an energy level to provide efficient energy filtering separation between these two types of ions. On the other hand, when a retarding field is applied, to effect energy filtering, within the collision cell, the discrimination is applied while there is a distinct energy difference between the unwanted ions and desired analyte ions. Therefore, the technique of the present invention should be applicable to many different collision cell designs, and could in some instances be competitive with or superior to the DRC (bandpass) method.

What is claimed is:

1. A method of operating a mass spectrometer system including a processing section having an input and an output, the method comprising:

a) providing a stream of ions to the input of the processing section defining a path for travel of ions and including means for guiding ions along the path;

b) passing the stream of ions through the processing section which is operated under conditions enabling collisions of ions with neutral particles;

c) providing an internal field extending along at least part of the path of the processing section, to retard movement of ions through the processing section; and d) selecting the internal field to provide significantly greater retardation to unwanted ions having lower kinetic energy than desired analyte ions, so as to promote retardation of said unwanted ions and preferential loss of said unwanted ions and to enhance the ratio of said analyte ions to said unwanted ions.

2. A method as claimed in claim 1 wherein the unwanted ions comprise at least one of: ions generated by an ion source; ions generated within the processing section by reaction with the neutral particles; and ions produced by other processes within the processing section.

3. A method as claimed in claim 1 or 2, wherein the unwanted ions include polyatomic source ions having a different rate of energy damping compared to the desired, analyte ions.

4. A method as claimed in claim 1, which includes providing the internal field as an electrostatic field.

5. A method as claimed in claim 1, which includes providing the internal field as an electrodynamic field.

6. A method as claimed in claim 5, which includes providing the electrodynamic field by application of an alternating current wave form to electrodes around the processing section.

7. A method as claimed in claim 1, 4, or 5 which includes providing a multipole rod set within the processing section, as said means for guiding the ions, and applying voltages to the multipole rod set to effect guiding of ions along the path.

8. A method as claimed in claim 7, which includes applying RF voltages to the multipole rod set.

9. A method as claimed in claim 7, which includes applying RF voltages and DC voltages to the multipole rod set, to generate a pass band.

10. A method as claimed in claim 9, which includes adjusting the RF and DC voltages or RF frequency to select a desired pass band for a desired analyte ion, to permit passage of the desired ion through the processing section and to promote rejection of precursor ions tending to form interferences with the desired ions.

11. A method as claimed in claim 7, which includes providing a quadrupole rod set as said multipole rod set.

12. A method as claimed in claim 11, which includes applying RF voltages to the quadrupole rod set.

13. A method as claimed in claim 11, which includes supplying both RF and DC voltages to the quadrupole rod set.

14. A method as claimed in claim 13, which includes adjusting the RF and DC voltages or RF frequency to select a desired pass band for a desired analyte ion, to permit passage of the desired ion through the processing section and to promote rejection of precursor ions tending to form interferences with the desired ions.

15. A method as claimed in claim 7, which includes providing auxiliary electrodes for generating of the internal field.

16. A method as claimed in claim 15, which includes providing for the auxiliary electrodes to protrude at least partially between the rods of the multipole rod set, thus generating the internal field within the rods.

17. A method as claimed in claim 15, which includes providing the auxiliary electrodes with a radially inner surface that varies non-linearly along the length of the processing section, to reduce variations in the internal field along the processing section.

18. A method as claimed in claim 7, which includes providing the multipole rod set with segmented electrodes, for generating the internal field.

19. A method as claimed in claim 7, which includes providing the multipole rod set with one of tilted electrodes and tapered electrodes for generating the internal field.

20. A method as claimed in claim 7, which includes providing electrodes external to the multipole rod set for generating the internal field.

21. A method as claimed in claim 1, which includes detecting ions exiting from the processing section.

22. A method as claimed in claim 7, which includes detecting ions exiting from the processing section.

23. A method comprising:

operating a pressurized processing section of a mass spectrometer system at a pressure sufficiently high to promote collisions between neutral particles in the processing section and ions; and generating an internal electromagnetic field along at least part of a path of the processing section to retard movement of ions through the processing section so that the movement of ions having lower kinetic energy is retarded more than the movement of ions having higher kinetic energy.

24. A method comprising:

operating a pressurized processing section of a mass spectrometer system at a pressure sufficiently high to promote reactions between neutral particles in the processing section and ions; and generating an internal electromagnetic field along at least part of a path of the processing section to retard movement of ions through the processing section so that the movement of ions having lower kinetic energy is retarded more than the movement of ions having higher kinetic energy.

25. A method comprising:

operating a pressurized processing section of a mass spectrometer system at a pressure sufficiently high to remove a substantial portion of interference ions produced by an analyte ion source of said system; and generating an internal electromagnetic field along at least part of a path of the processing section to retard movement of ions through the processing section so that the movement of ions having lower kinetic energy is retarded more than the movement of ions having higher kinetic energy.

* * * * *

UNITED STATES PATENT AND TRADEMARK OFFICE

CERTIFICATE OF CORRECTION

PATENT NO. : 6,627,912 B2 
DATED : September 30, 2003
INVENTOR(S) : Dmitry R. Bandura, Vladimir I Baranov and Scott D. Tanner It is certified that error appears in the above-identified patent and that said Letters Patent is hereby corrected as shown below:

Drawings,
Sheets 1-5, consisting of Figures 1, 2a, 2b, 3, 4 and 5, should be replaced with
Sheets 1-3, consisting of Figures 1, 2a, 2b, 3, 4, and 5, as shown on the attached pages.

Signed and Sealed this

Twenty-fourth Day of August, 2004

JON W. DUDAS
*Director of the United States Patent and Trademark Office*

(12) United States Patent
Bandura et al.

(10) Patent No.: US 6,627,912 B2
(45) Date of Patent: Sep. 30, 2003

(54) METHOD OF OPERATING A MASS SPECTROMETER TO SUPPRESS UNWANTED IONS

(75) Inventors: Dmitry R. Bandura, Aurora (CA); Vladimir I. Baranov, Richmond Hill (CA); Scott D. Tanner, Aurora (CA)

(73) Assignee: MDS Inc., Concord (CA)

( * ) Notice: Subject to any disclaimer, the term of this patent is extended or adjusted under 35 U.S.C. 154(b) by 69 days.

(21) Appl. No.: 09/853,715

(22) Filed: May 14, 2001

(65) Prior Publication Data

US 2002/0166959 A1 Nov. 14, 2002

(51) Int. Cl.[7] ..... H01J 49/42

(52) U.S. Cl. ..... 250/582; 250/292

(58) Field of Search ..... 250/282

(56) References Cited

U.S. PATENT DOCUMENTS

| | | | | |
|---|---|---|---|---|
| 4,731,533 A | | 3/1988 | Vestal | |
| 4,963,736 A | | 10/1990 | Douglas et al. | 250/292 |
| 5,661,300 A | * | 8/1997 | Hansen et al. | 250/287 |
| 5,847,386 A | | 12/1998 | Thomson et al. | 250/288 |
| 6,121,607 A | * | 9/2000 | Whitehouse et al. | 250/288 |
| 6,140,638 A | | 10/2000 | Tanner et al. | 250/282 |
| 6,163,032 A | * | 12/2000 | Rockwood | 250/396 R |
| 6,222,185 B1 | * | 4/2001 | Speakman et al. | 250/288 |

OTHER PUBLICATIONS

Rowan et al. "Attenuation of Polyatomic Ion Interferences in Inductively Coupled Mass Spectrometry by Gas–Phase Collisions", Applied Spectroscopy, vol. 43, No. 6, pp. 976–980, 1989.*

Hattendorf et al. "Optimization Criteria for the Operation of a Reaction Cell ICP–MS for Fast Transient Signal Acquisition", European Winter Conference on Plasma Spectrochemistry, Hafnell, Norway, paper # 0–75, Feb. 4–8, 2001.*

Thompson et al. "RF–Only Quadrupoles with Axial Fields", 44th ASMS Conference, Portland, Oregon abstract No. 1155, May 12–16, 1996.*

Loboda et al. "Novel LINAC II electrode geometry to create an axial field in a multipole ion guide", 48th ASMS Conference, Long Beach, California, paper # WPA 016, Jun. 11–15,2000.*

J.T. Rowan and R.S. Houk, "Attenuation of Polyatomic Ion Interferences in Inductively Coupled Plasma Mass Spectrometry by Gas–Phase Collisions", Applied Spectroscopy, vol. 43, No. 6, pp. 976–980, 1989.

A. Loboda, A. Krutchinsky, O. Loboda, J. McNabb, V. Spicer, W. Ens, and K. Standing, "Novel LINAC II electrode geometry to create an axial field in a multiple ion guide", 48th ASMS Conference, Long Beach, California, (paper # WPA 016), Jun. 11–15, 2000.

(List continued on next page.)

*Primary Examiner*—John R. Lee
*Assistant Examiner*—James J Leybourne ,
(74) *Attorney, Agent, or Firm*—Bereskin & Parr

(57) ABSTRACT

In a mass spectrometry system, a method of operating a processing section, for example a collision cell, is provided. The method is based on the realization that some interfering ions after collision will have significantly lower kinetic energy than desired analyte ions. These interfering ions can be ions originating from the source, or product ions formed by reaction with gas particles, or ions produced by other processes within the cell. Significantly, these interfering ions can have lower kinetic energies, as compared to desired analyte ions, but this energy differential disappears, or is much reduced, at the exit of the collision cell, rendering post-cell energy discrimination less effective. The invention provides a field within the cell to discriminate against the interfering ions based on their lower kinetic energy.

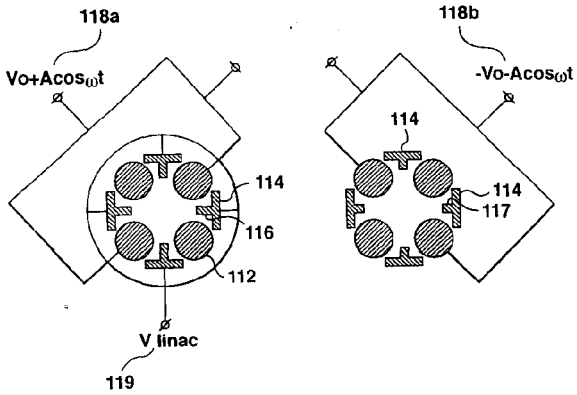

25 Claims, 5 Drawing Sheets